US009568269B1

(12) United States Patent
Chang

(10) Patent No.: US 9,568,269 B1
(45) Date of Patent: Feb. 14, 2017

(54) MULTIPLY SECURED CROSSBOW

(71) Applicant: Combis Sport Enterprise Co., Ltd., Taichung (TW)

(72) Inventor: Chu-Wei Chang, Taichung (TW)

( * ) Notice: Subject to any disclaimer, the term of this patent is extended or adjusted under 35 U.S.C. 154(b) by 0 days.

(21) Appl. No.: 15/141,804

(22) Filed: Apr. 28, 2016

(51) Int. Cl.
*F41B 5/12* (2006.01)
*F41A 19/10* (2006.01)
*F41C 23/20* (2006.01)

(52) U.S. Cl.
CPC ..... *F41B 5/12* (2013.01); *F41A 19/10* (2013.01); *F41C 23/20* (2013.01)

(58) Field of Classification Search
CPC ..... F41B 5/12
See application file for complete search history.

(56) References Cited

U.S. PATENT DOCUMENTS 5,215,069 A * 6/1993 Liu ..... F41B 5/12 124/25
7,588,022 B2 * 9/2009 Chang ..... F41B 5/123 124/25
7,770,567 B1 * 8/2010 Yehle ..... F41A 17/46 124/25
8,522,761 B1 * 9/2013 Chu ..... F41A 17/46 124/25
2012/0048252 A1 * 3/2012 Chu ..... F41B 5/12 124/25

* cited by examiner

*Primary Examiner* — John Ricci

(57) ABSTRACT

A crossbow includes a supporting body, a hook unit, a bow and a triggering device. The supporting body includes an elongated portion and a butt detachably connected to the elongated portion. The hook unit is provided on the butt. The bow is provided on the supporting body. The triggering device is located in the elongated portion to control the bow. The triggering device includes a shell, a trigger unit located in the shell, and a security unit movable between a locking position and an unlocking position. The security unit abuts against the trigger unit in the locking position to restrain the trigger unit. The hook unit moves the security unit to the unlocking position when the butt is connected to the elongated portion. The security unit moves to the locking position when the butt is moved from the elongated portion.

15 Claims, 11 Drawing Sheets

MULTIPLY SECURED CROSSBOW

BACKGROUND OF INVENTION

1. Field of Invention

The present invention relates to a crossbow and, more particularly, to a crossbow with multiple security units that are automatically activated during the loading of a bolt and cannot be relieved until the bolt is properly loaded and ready for projection.

2. Related Prior Art

As disclosed in Taiwanese Patent No. 207344 for example, a typical crossbow includes an elongated body 10, a wing (not shown) transversely connected to a front portion of the elongated body 10, a string (not shown) connected to the wing at two ends, a pull turner 14 supported on the elongated body 10, and a trigger 16 connected to the elongated body 10. The pull turner 14 is operable to pull the string to a tight, stressed or loaded status. The trigger 16 is operable to lock or release the string. The pull turner 14 is a substantially U-shaped element made by bending a rigid wire. The pull turner 14 includes two branches each including a crook end 141 for hooking the string.

The use of this typical crossbow is not without any problem. For example, the user could project a bolt by mistake while loading the bolt onto the crossbow. Such accidental projection of the bolt imposes danger on the user and nearby people.

Some crossbows are provided with security devices. However, such a security device cannot be activated until the string of a crossbow is pulled and hooked by the trigger of the crossbow. Such a security device is not automatically activated. A user could easily forget to activate the security device. Hence, the security device does not ensure the security of the user or nearby people.

The present invention is therefore intended to obviate or at least alleviate the problems encountered in prior art.

SUMMARY OF INVENTION

It is the primary objective of the present invention to provide a crossbow that is automatically locked during the loading of a bolt and cannot be released until the bolt is properly loaded.

To achieve the foregoing objective, the crossbow includes a supporting body, a hook unit, a bow and a triggering device. The supporting body includes an elongated portion and a butt detachably connected to the elongated portion. The hook unit is provided on the butt. The bow is provided on the supporting body. The triggering device is located in the elongated portion to control the bow. The triggering device includes a shell, a trigger unit located in the shell, and a security unit movable between a locking position and an unlocking position. The security unit abuts against the trigger unit in the locking position to restrain the trigger unit. The hook unit moves the security unit to the unlocking position when the butt is connected to the elongated portion. The security unit moves to the locking position when the butt is moved from the elongated portion.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
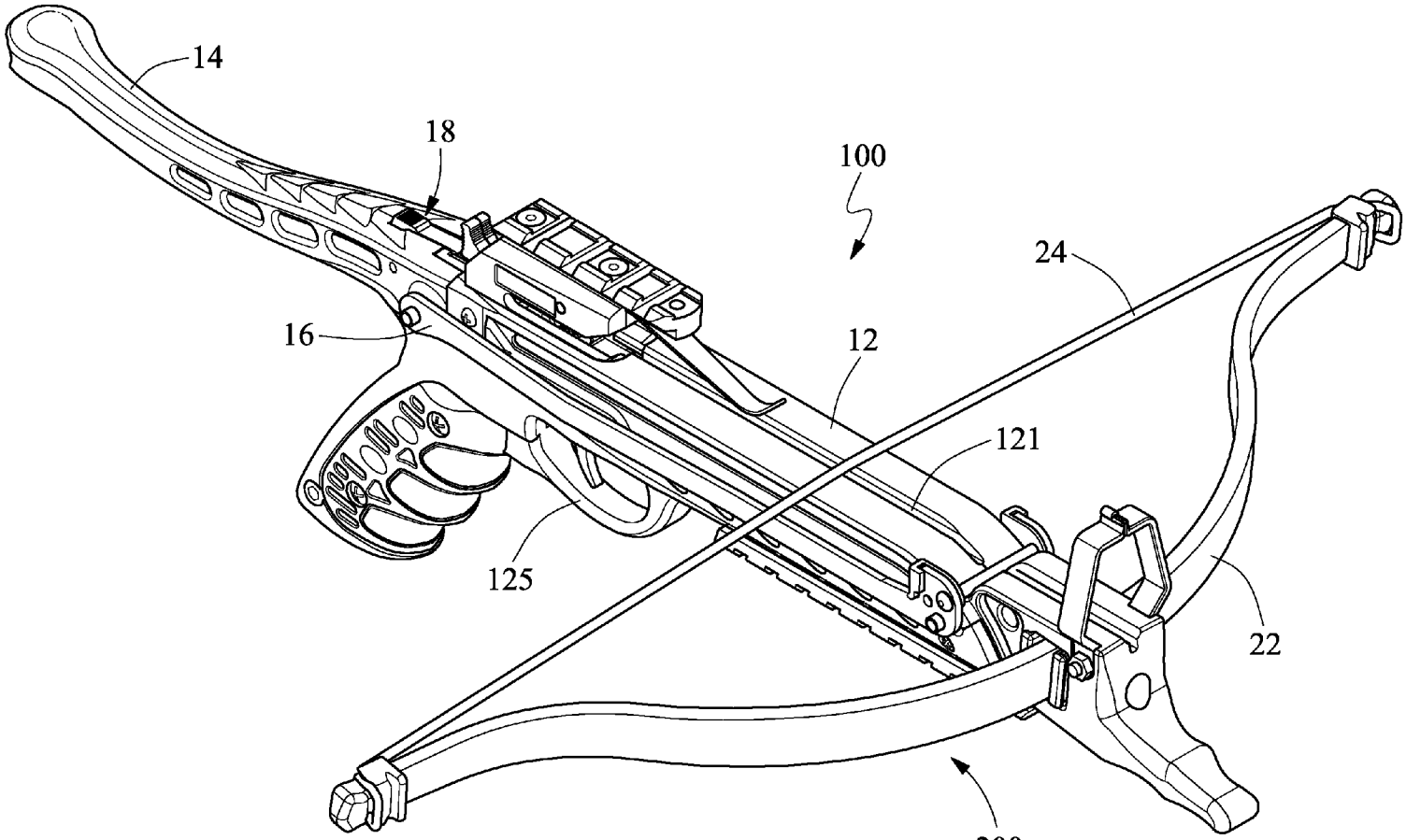
FIG. 1 is a perspective view of a crossbow according to the preferred embodiment of the present invention.

Referring to FIGS. 1 through 5, a crossbow includes a supporting body 100, a bow 200 and a triggering device 300 according to the present invention. The supporting body 100 includes an elongated portion 12, a grip (not numbered) and a butt 14. The grip extends from a lower face of the elongated portion 12, near a rear end. The grip and the elongated portion 12 are made in one piece. The butt 14 is pivotally connected to a lower end of the grip. Two pull turners 16 are movably connected to the elongated portion 12.

The elongated portion 12 includes at least one groove 121, a cavity 122, a pin 123, a recess 124 and a trigger guard 125. The groove 121 is made in an upper face of the elongated portion 12. The groove 121 extends along the elongated portion 12. The cavity 122 extends to the lower face of the elongated portion 12 from the upper face, thus providing access to the trigger guard 125. The pin 123 is transversely supported on the elongated portion 12, near the cavity 122. The recess 124 is made in the grip, in communication with the cavity 122.

The butt 14 is made with a bent configuration that includes two portions. The first portion of the butt 14 is pivotally connected to the lower end of the grip. The first portion of butt 14 can be inserted in the recess 124. The second portion of the butt 14 can be placed against a shoulder of a user.

Figure 2:
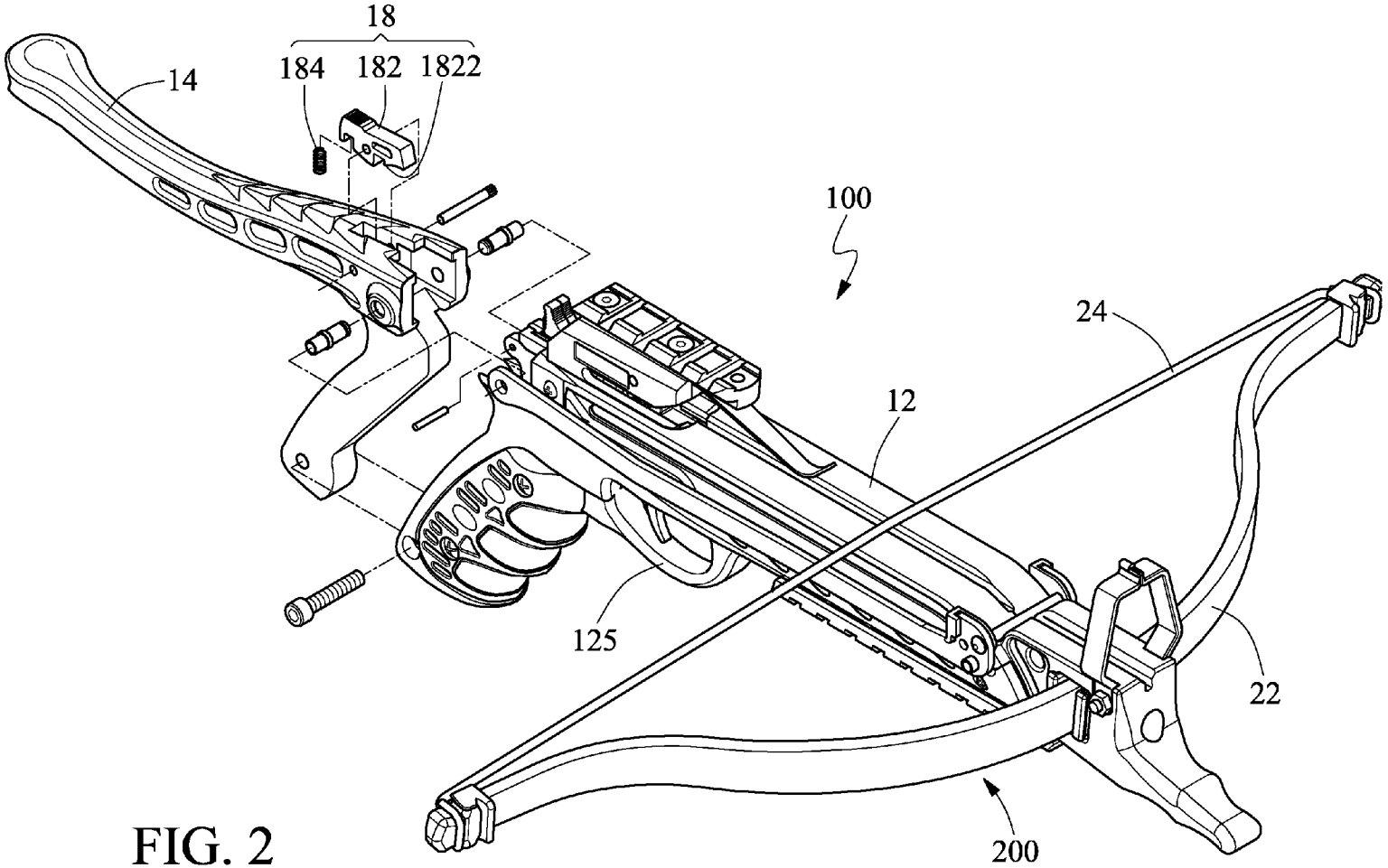
FIG. 2 is an exploded view of the crossbow shown in FIG. 1.
Figure 8:
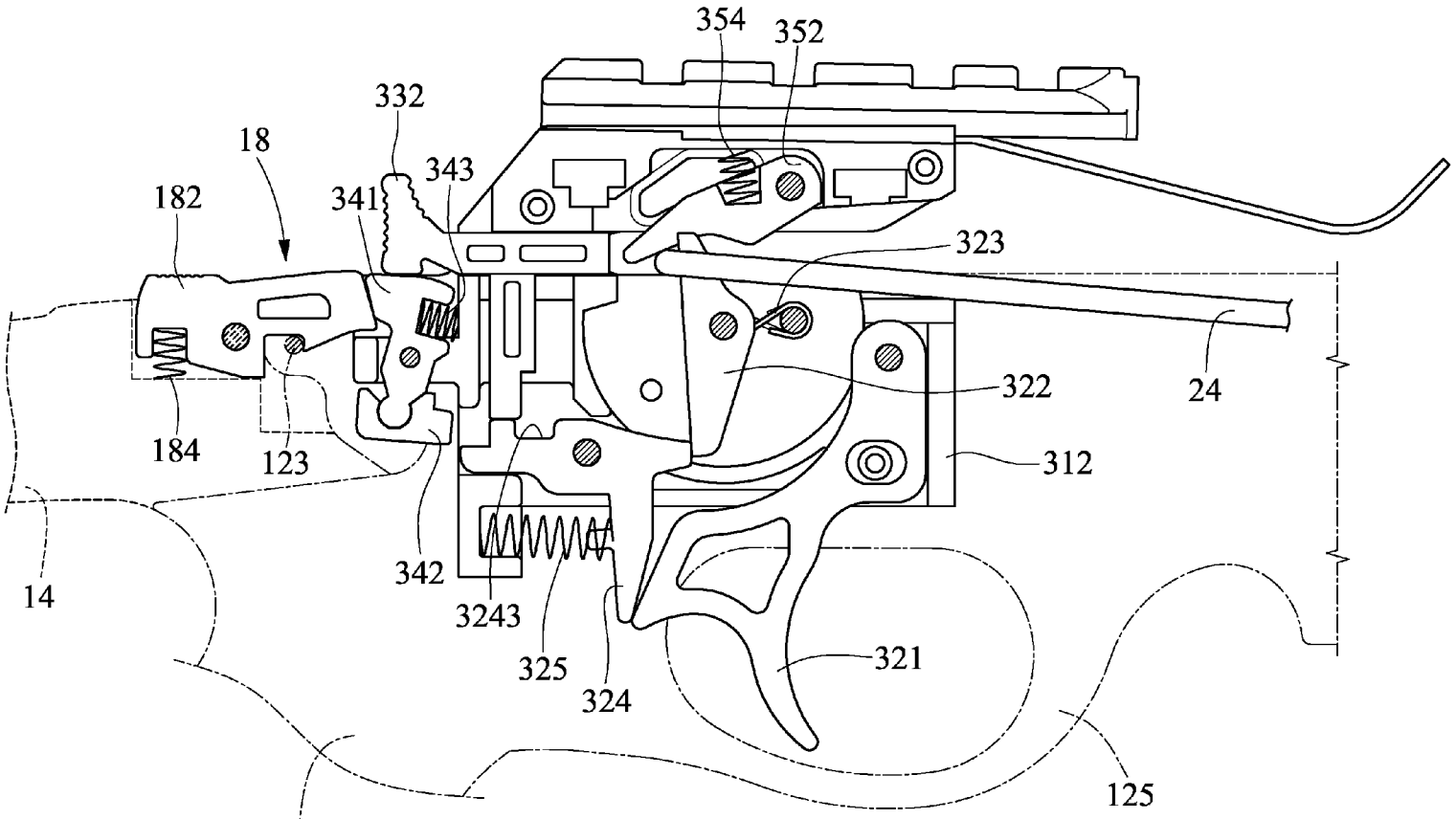
FIG. 8 is a cross-sectional view of the trigger unit shown in FIG. 4.

Referring to FIG. 2, a hook unit 18 is provided on an upper face of the second portion of the butt 14. The hook unit 18 includes a hook 182 and a spring 184. The hook 182 is pivotally connected to the second portion of the butt 14. The hook 182 includes a barb 1822 formed on a lower face, near a front end. The barb 1822 is adapted for engagement with the pin 123. The upper face of a rear portion of the hook 182 can be pushed to pivot the barb 1822 of the hook 182 to an unhooking position (FIG. 6) from a hooking position (FIG. 8). The spring 184 includes an end abutted against the butt 14 and another end abutted against the rear portion of the hook 182. Thus, the spring 184 tends to keep the barb 1822 of the hook 182 in the hooking position to keep the first portion of the butt 14 in the recess 124 and the second portion of the butt 14 in line with the elongated portion 12. The hook unit 18 can be made in any other proper configuration than that is shown in FIG. 2 as long as it can abut against the triggering device 300.

Figure 3:
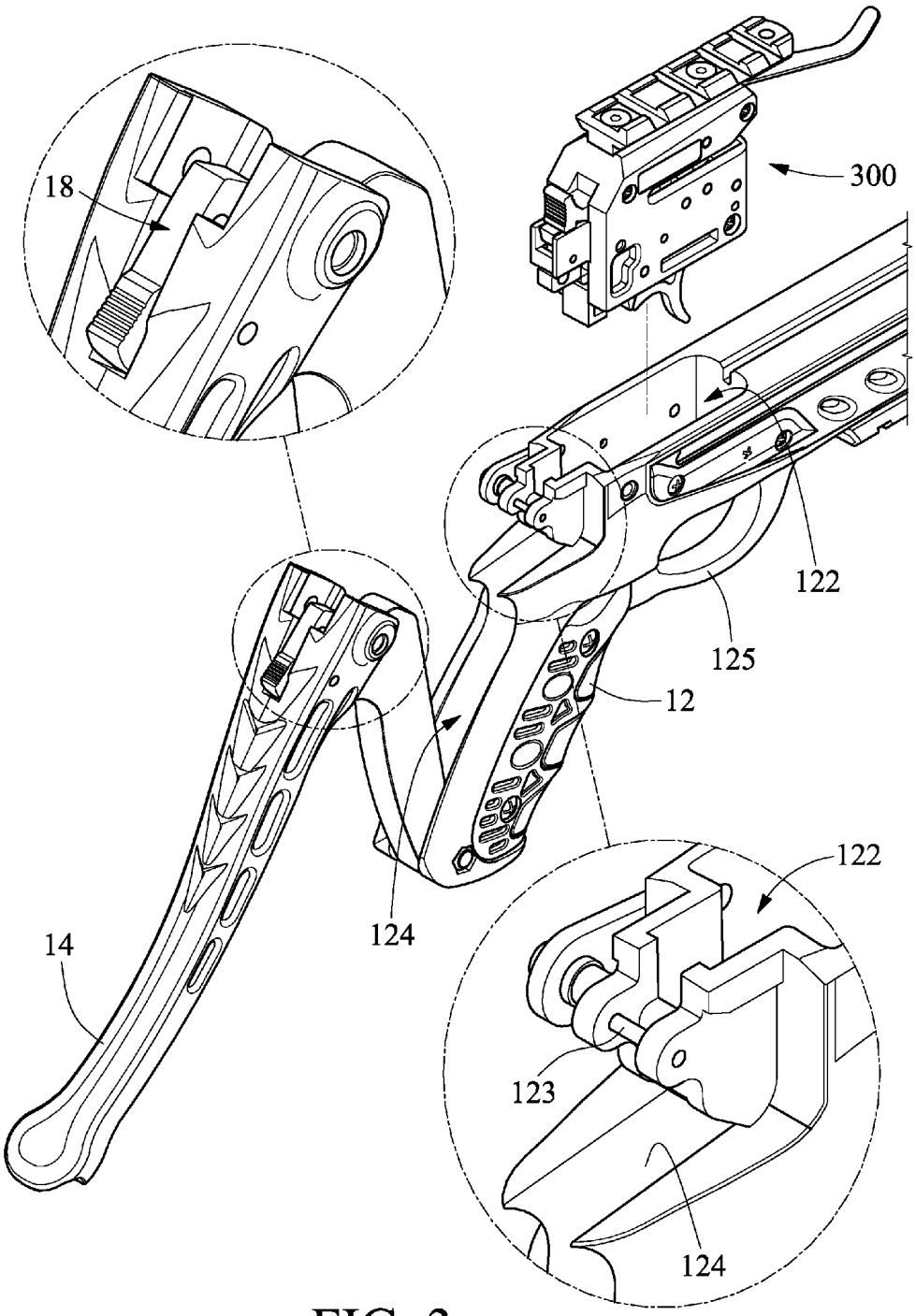
FIG. 3 is a partial, exploded view of the crossbow shown in FIG. 2.

Referring FIGS. 1 through 3, each of the pull turners 16 is provided on a lateral face of the elongated portion 12. Each of the pull turners 16 includes a front portion for engagement with the elongated portion 12 and a rear end pivotally connected to the second portion of the butt 14.

The bow 200 is transversely supported on the upper face of a front portion of the elongated portion 12. The bow 200 includes a wing 22 and a string 24. The wing 22 includes two portions extending from the lateral faces of the elongated portion 12. The string 24 is connected to the wing 22 at two ends. The pull turners 16 are operable to pull the string 24.

Figure 4:
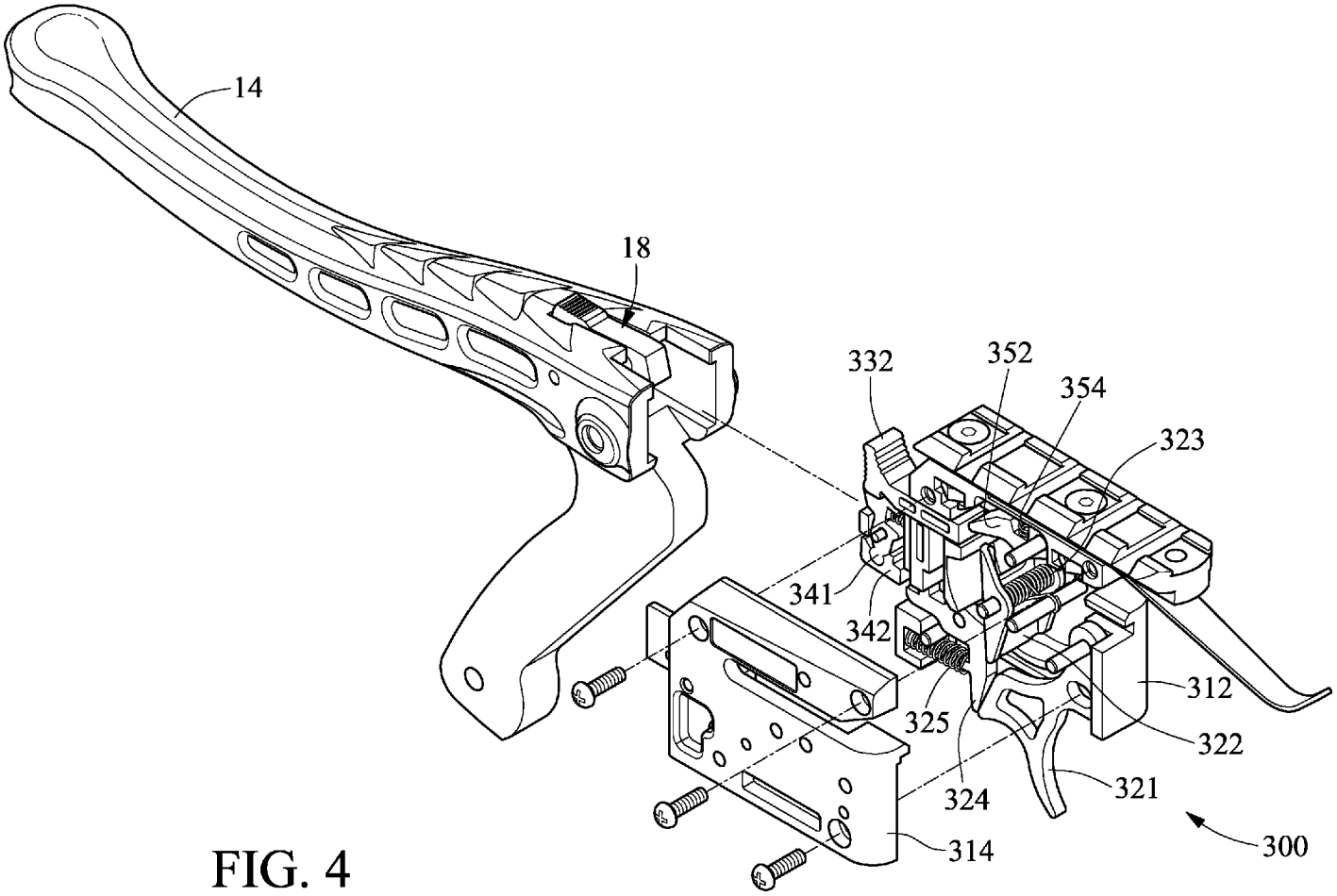
FIG. 4 is an exploded view of a trigger unit of the crossbow shown in FIG. 2.
Figure 5:
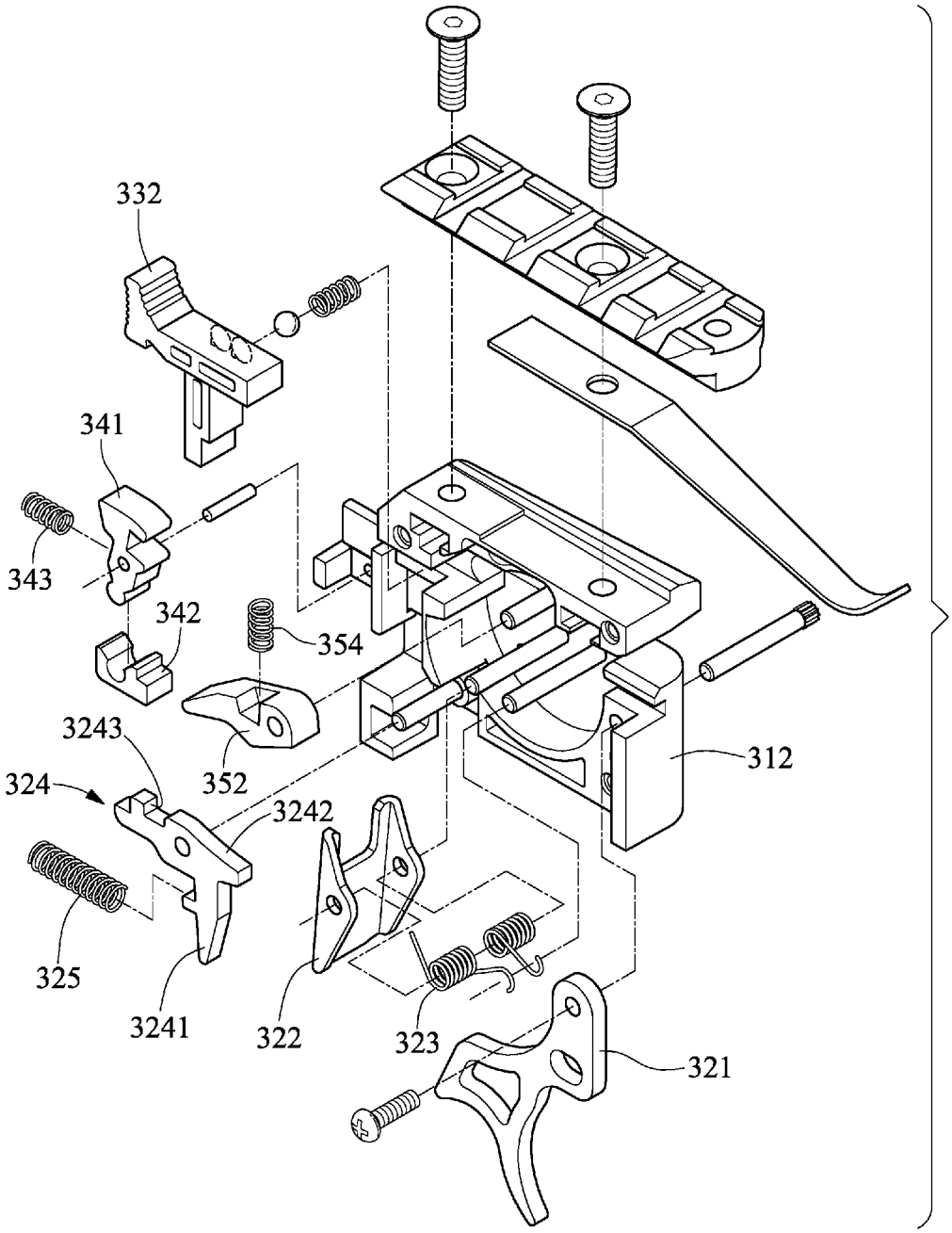
FIG. 5 is another exploded view of the trigger unit of the crossbow shown in FIG. 4.

Referring to FIGS. 3 through 5, the triggering device 300 is located in the cavity 122 of the elongated portion 12. The triggering device 300 includes a shell, a trigger unit, a first security unit, a second security unit and a third security unit.

The shell contains the trigger unit and the first, second and third security units. The shell includes two lateral pieces 312 and a cover 314. The shell includes a front opening for communication with the groove 121, a lower opening for communication with the cavity 122, and a rear opening for communication with the recess 124.

The trigger unit includes a trigger 321, a string-catching element 322, a torque spring 323, a restraining element 324, and a spring 325. The trigger 321 includes an end inserted in and pivotally connected to the shell and another end extending to the vicinity of the trigger guard 125 via the lower opening of the shell.

Figure 11:
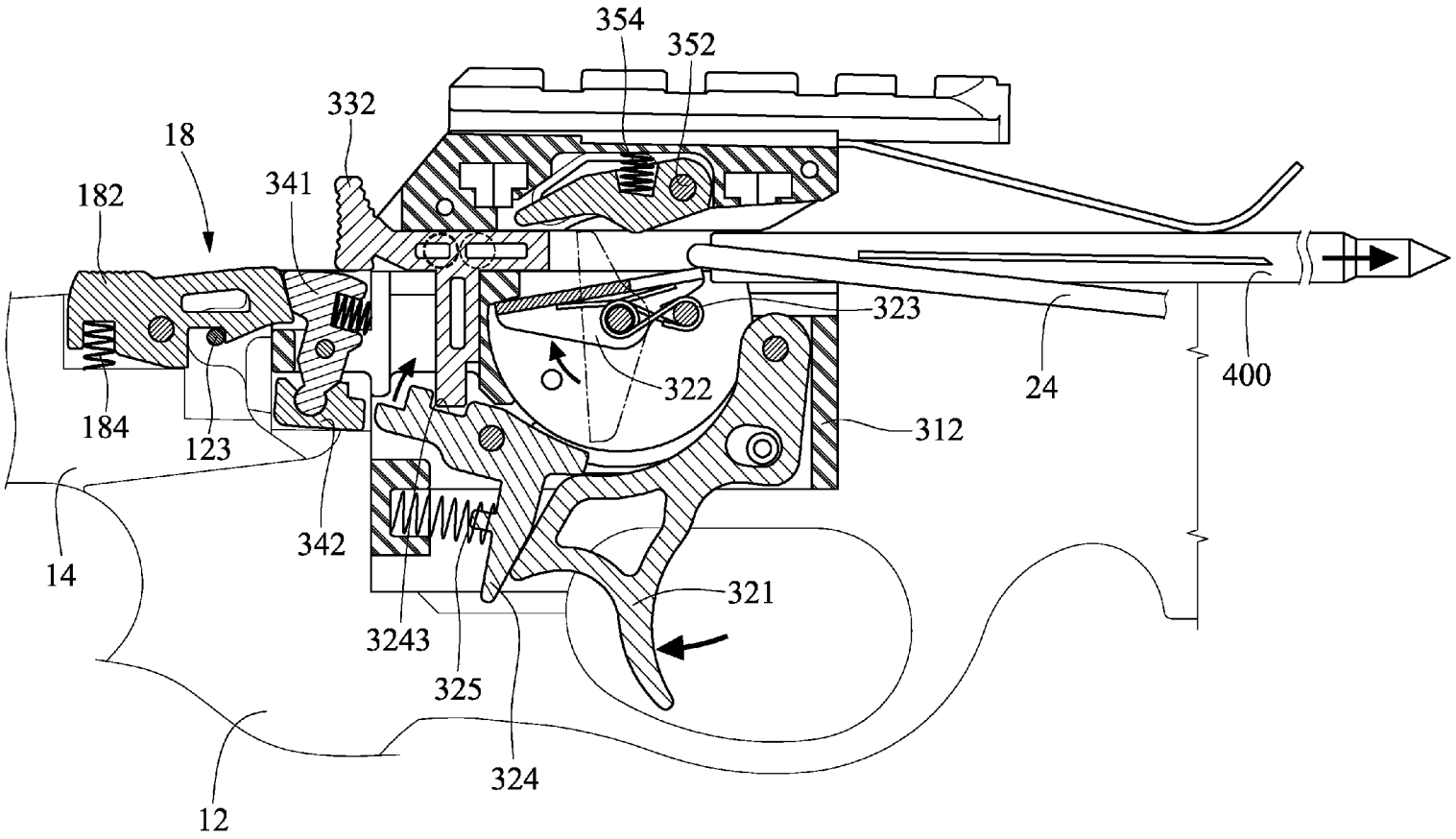
FIG. 11 is a cross-sectional view of the trigger unit in another position than shown in FIG. 10.

The string-catching element 322 and the torque spring 323 are supported on a common pivot (not numbered) inserted in and connected to the shell. The string-catching element 322 can be pivoted between a catching position (FIG. 8) and an un-catching position (FIG. 11). The string-catching element 322 includes an upper portion for engagement with the string 24 and a lower portion for cooperation with the restraining element 324. The torque spring 323 tends to keep the string-catching element 322 in the catching position (FIG. 8).

The restraining element 324 includes a vertical portion 3241 and a horizontal portion 3242. A cutout 3243 is made in an upper portion of the horizontal portion 3242. The restraining element 324 is pivotally located in and connected to the shell by a pivot (not numbered). A lower end of the vertical portion 3241 is in contact with the trigger 321. A front end of the horizontal portion 3242 of the restraining element 324 is in contact with the string-catching element 322. The restraining element 324 is pivoted between a restraining position (FIG. 8) and a releasing position (FIG. 11) by the trigger 321. The spring 325 tends to keep the restraining element 324 in the restraining position (FIG. 8).

Figure 10:
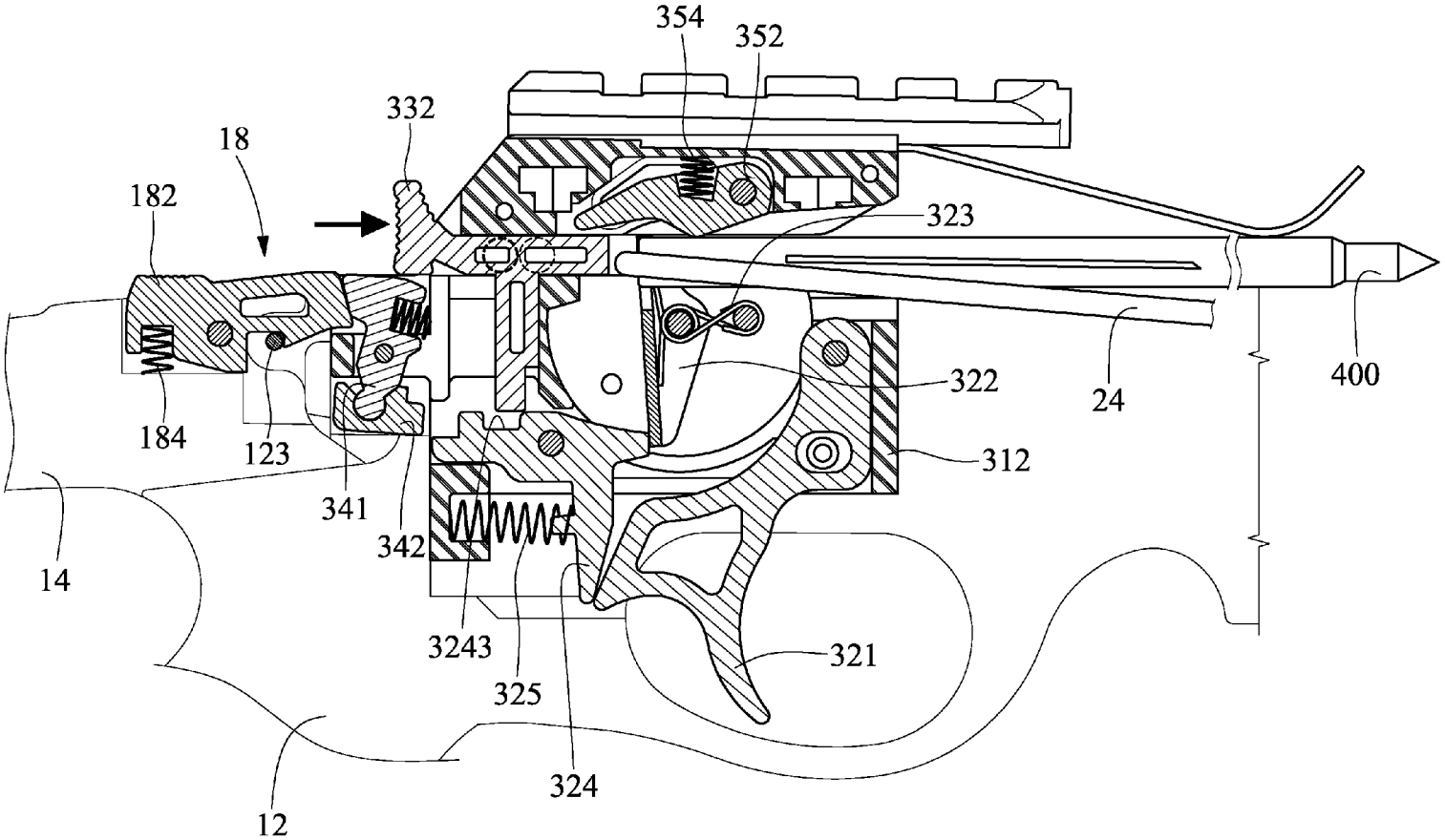
FIG. 10 is a cross-sectional view of the trigger unit in another position than shown in FIG. 9.

The first security unit includes a pusher 332 formed with a front portion, a rear portion and a lower portion. The pusher 32 is movably located in the shell between an abutting position (FIG. 6) and a retreating position (FIG. 10). The rear portion of the pusher 332 is located out of the shell and the grip. In the retreating position, the lower portion of the pusher 332 is inserted in the cutout 3243 of the restraining element 324, not abutting against the restraining element 324 but allowing the trigger 321 to be pulled. In the abutting position, the lower portion of the pusher 332 abuts against the horizontal portion 3242 of the restraining element 324 to prevent the restraining element 324 from pivoting, thus providing security.

The second security unit includes a lever 341, a sliding element 342, and a spring 343. The lever 341 is located in and pivotally connected to the shell between two positions respectively shown in FIGS. 6 and 8. A lower portion of the lever 341 is inserted in a recess made in an upper face of the sliding element 342 like a ball-and-socket configuration. Thus, the lever 341 is pivotally connected to the sliding element 342 so that the lever 341 can move the sliding element 342 between a locking position (FIG. 6) and an unlocking position (FIG. 8). In the locking position, the sliding element 342 abuts against the horizontal portion 3242 of the restraining element 324 to prevent the restraining element 324 from pivoting, thus providing further security. The spring 343 is located in the shell to pivot the lever 341 to the first position (FIG. 6) normally. The lever 341 can be pushed by the hook unit 18, which is provided on the butt 14, to the second position (FIG. 8).

Figure 9:
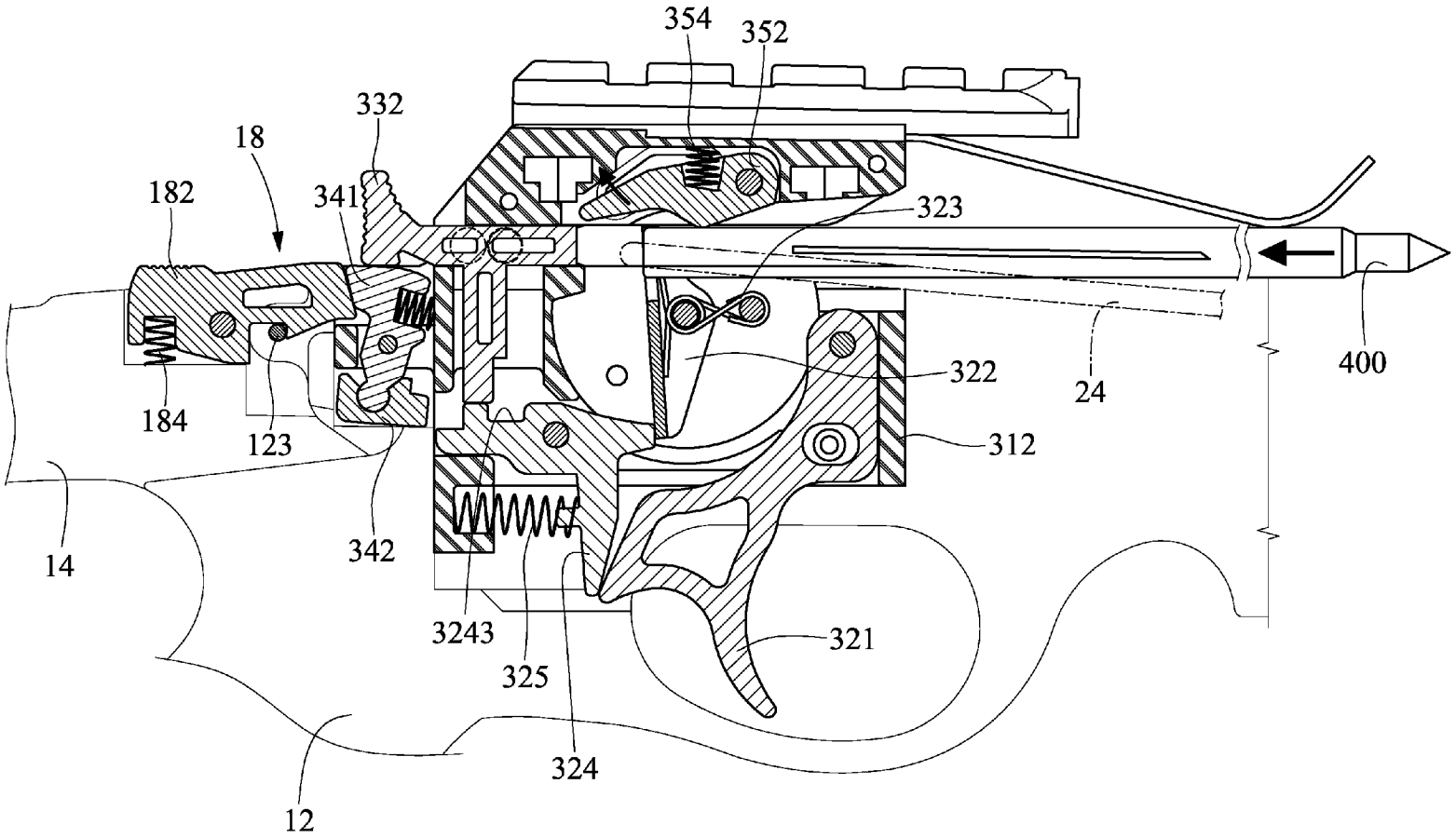
FIG. 9 is a cross-sectional view of the trigger unit in another position than shown in FIG. 8.

The third security unit includes a lever 352 and a spring 354. The lever 352 is inserted in and pivotally connected to the shell, above the string-catching element 322. The lever 352 is pivoted between a blocking position (FIG. 8) and a give-way position (FIG. 9). In the blocking position, a lower portion of the lever 352 gets in the way of the pusher 332 to the retreating position and blocks the pusher 332. In addition, as a bolt 400 is loaded and moved in and along the groove 121, the bolt 400 pushes the lever 352, thus causing the lever 352 to pivot toward the give-way position. Synchronously, the lower portion of the lever 352 pushes the pusher 332 to the abutting position.

The operation of the crossbow will be described. Firstly, the pulling of the string 24, and the operation of the hook unit 18 and the operation of the first and security units will be described referring to FIGS. 6 to 8. The hook unit 18, which is provided on the butt 14, is operated to release the butt 14 and the elongated portion 12 from the locked status. The rear portion of the hook 182 of the hook unit 18 is pushed to move the barb 1822 of the hook 182 upwards to the unhooking position (FIG. 6) from the hooking position (FIG. 8). Thus, the barb 1822 of the hook 182 is disengaged from the pin 123, which is connected to the elongated portion 12. The butt 14 is pivoted relative to the elongated portion 12 so that they are moved away from each other. As the butt 14 is moved away from the elongated portion 12, the butt 14 synchronously moves the pull turners 16 along the lateral faces of the elongated portion 12 (FIG. 7) to pull the string 24 toward the triggering device 300, over the upper portion of the string-catching element 322. Thus, the string-catching element 322 temporarily prevents the string 24 from returning to its original position.

Figure 6:
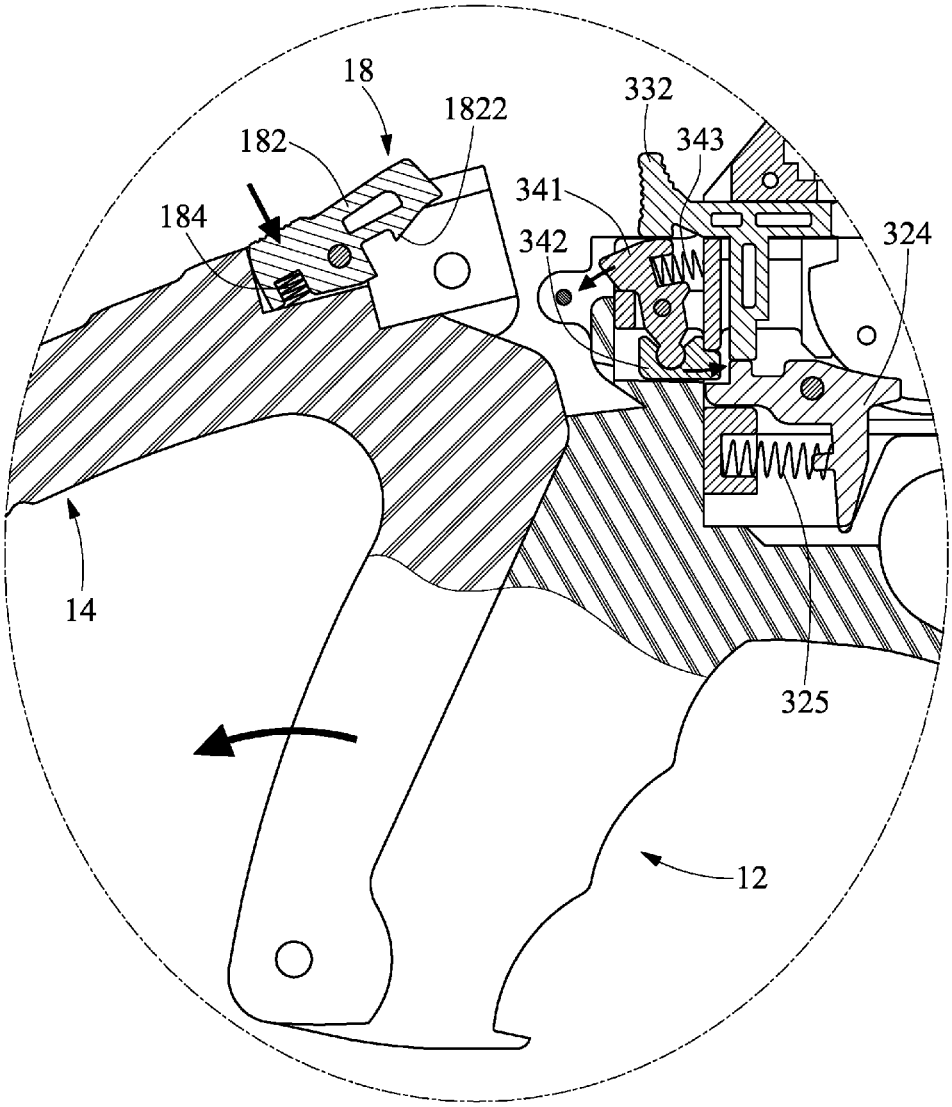
FIG. 6 is a partial, cross-sectional view of the trigger unit shown in FIG. 4.
Figure 7:
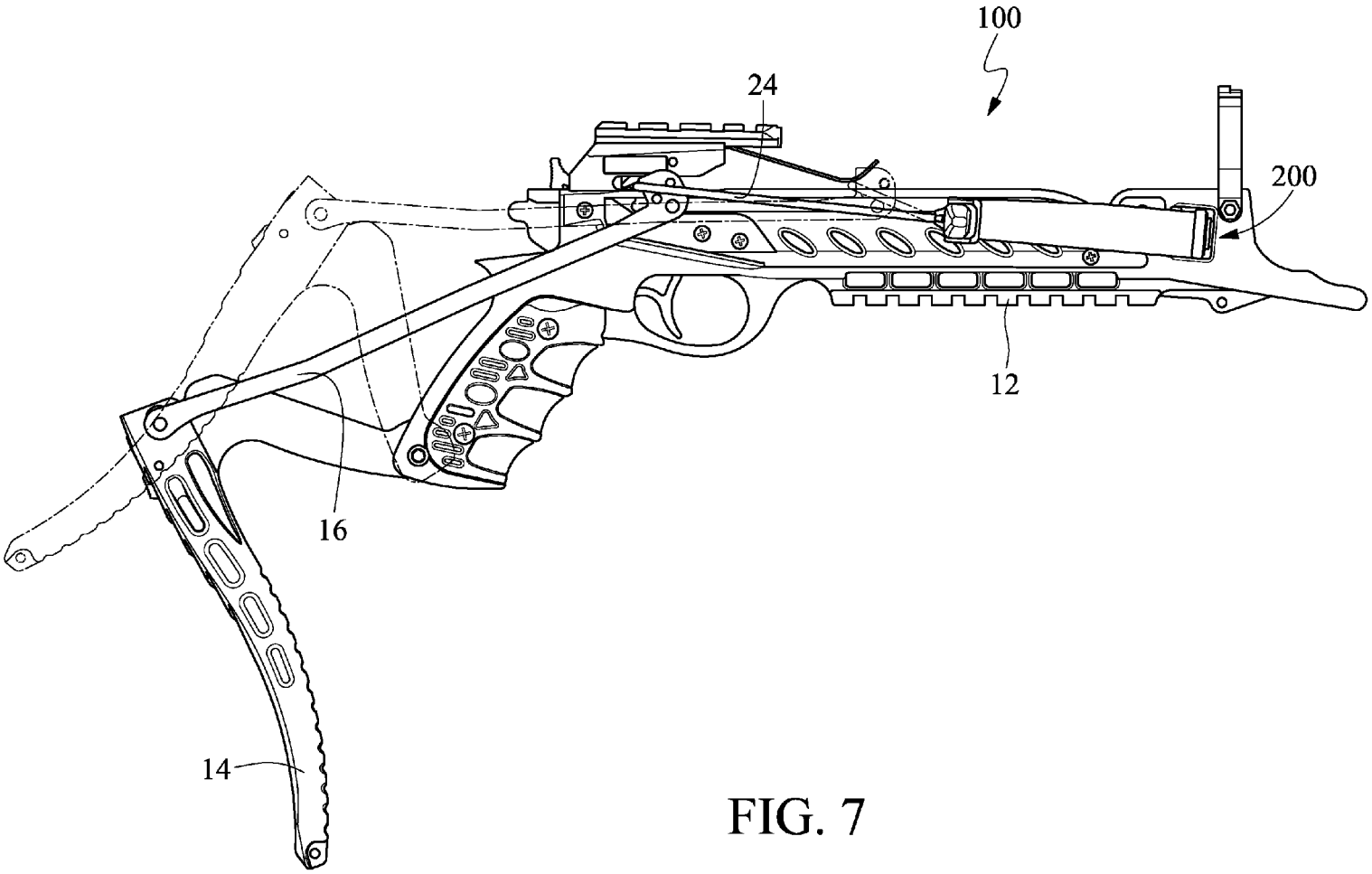
FIG. 7 is a side view of the crossbow shown in FIG. 1.

While the string 24 is moved over the string-catching element 322, the pusher 332 of the first security unit is synchronously moved to make sure that the pusher 332 be moved to the abutting position (FIG. 6). Now, the lower portion of the pusher 332 abuts against the upper portion of the horizontal portion 3242 of the restraining element 324, thus holding the trigger unit in position. That is, the trigger 321 cannot be moved, and neither can the restraining element 324. Hence, the first security unit is activated.

As the second portion of the butt 14 is away from the elongated portion 12 (FIG. 6), the hook unit 18, which is provided on the butt 14, no longer abuts against the rear portion of the lever 341 of the second security unit, thus allowing the spring 343 to pivot the lever 341 to the first position from the second position. Hence, the sliding element 342 abuts against the horizontal portion 3242 of the restraining element 324 to prevent the restraining element 324 from pivoting. Thus, the second security unit is activated to ensure that the trigger unit cannot be pulled when the butt 14 is away from the elongated portion 12.

The relief of the second security unit as the butt 14 is away from the elongated portion 12 will be described. After the string 24 is pulled, the second portion of the butt 14 is moved to the elongated portion 12, and the hook unit 18, which is provided on the butt 14, abuts against the lever 341 of the second security unit, and compresses the spring 343. Thus, the lever 341 is pivoted to the second position (FIG. 8) from the first position (FIG. 6). Hence, the sliding element 342 no longer abuts against the horizontal portion 3242 of the restraining element 324. That is, the second security unit is relieved.

The operation of the third security unit will be described. The spring 354 normally keeps the lever 352 in the blocking position so that the lower portion of the lever 352 gets in the way of the pusher 332 to the retreating position and blocks the pusher 332, i.e., the pusher 332 cannot be pushed to the retreating position. Thus, the third security unit is activated to ensure that the trigger unit not be pulled to release the string 24 before the loading of the bolt 400 is completed.

As the bolt 400 is moved in and along the groove 121, the bolt 400 pushes the lever 352 to the give-way position (FIG. 9) from the blocking position (FIG. 8). Thus, the third security unit is relieved, no longer blocking the way of the pusher 332 to the retreating position.

The relief of the first security unit and the operation of the trigger unit will be described hereinafter. Referring to FIG. 10, with the second and third security units relieved, the string 24 can be released to project the bolt 400. To this end, the pusher 332 is moved to the give-way position from the blocking position so that the lower portion thereof is flush with the cutout 3243 of the horizontal portion 3242 of the restraining element 324, no longer blocking the restraining element 324 but allowing the restraining element 324 to pivot.

Referring to FIG. 11, the trigger 321 is pulled to abut against the lower portion of the restraining element 324, thus pivoting the restraining element 324 to the give-way position from the blocking position. That is, the restraining element 324 does not block the string-catching element 322. For the torque provided by the torque spring 323 is smaller than the torque provided by the string 24, the string-catching element 322 yields to the string 24. Thus, the string-catching element 322 is moved to the un-catching position (FIG. 11) from the catching position (FIG. 8). Hence, the string 24 is released to project the bolt 400 from the elongated portion 12 through the groove 121.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A crossbow comprising:

a supporting body (100) comprising an elongated portion (12) and a butt (14) detachably connected to the elongated portion (12);

a hook unit (18) provided on the butt (14);

a bow (200) provided on the supporting body (100), and a triggering device (300) located in the elongated portion (12) to control the bow (200), wherein the triggering device (300) comprises:

a shell;

a trigger unit located in the shell; and a security unit movable between a locking position and an unlocking position;

wherein the security unit abuts against the trigger unit in the locking position to restrain the trigger unit;

wherein the hook unit (18) moves the security unit to the unlocking position when the butt (14) is connected to the elongated portion (12);

wherein the security unit moves to the locking position when the butt (14) is moved from the elongated portion (12).

2. The crossbow according to claim 1, wherein the security unit comprises:

a sliding element (342) movable between the locking position for locking the trigger unit and the unlocking position;

a lever (341) comprising a lower portion pivotally connected to the sliding element (342), wherein the lever (341) can be pivoted between a first position corresponding to the locking position and a second position corresponding to the unlocking position; and a spring (343) for keeping the lever (341) in the first position, wherein the lever (341) is pivoted to the second position when the butt (14) is moved to the elongated portion (12), wherein the spring (343) pivots the lever (341) to the first position when the butt (14) is away from the elongated portion (12).

3. The crossbow according to claim 2, wherein the trigger unit comprises a trigger (321) comprising an upper portion pivotally located in the shell and a lower portion located out of the elongated portion (12);

a restraining element (324) movable between a restraining position for preventing the trigger (321) from pivoting and a releasing position for allowing the trigger (321) to pivot;

a string-catching element (322) comprising an upper portion for catching a string (24) of the bow (200) and a lower portion in contact with the restraining element (324), wherein the string-catching element (322) is movable between a catching position and an un-catching position;

a torque spring (323) for keeping the string-catching element (322) in the catching position; and a compression spring (325) for keeping the restraining element (324) in the restraining position.

4. The crossbow according to claim 3, wherein the restraining element (324) comprises comprising a cutout (3242) made in an upper portion, wherein the triggering device (300) further comprises a pusher (332) movable between an abutting position and a retreating position, wherein the pusher (332) comprises a lower portion that enters the cutout (3242) when the pusher (332) is in the retreating position and abuts against and prevents the restraining element (324) from pivoting when the restraining element (324) is in the abutting position.

5. The crossbow according to claim 4, wherein the triggering device (300) further comprises another security unit comprising:

a lever (352) movable between a blocking position and a give-way position, wherein the lever (352) gets in the way of the pusher (332) to the retreating position when the lever (352) is in the blocking position; and a spring (354) for keeping the lever (352) in the blocking position.

6. The crossbow according to claim 5, further comprises a pin (123) supported on the elongated portion (12) near the butt (14) and adapted for engagement with the hook unit (18) to keep the elongated portion (12) close to the butt (14).

7. The crossbow according to claim 6, wherein the hook unit (18) comprises:

a hook (182) comprising a barb (1822) for engagement with the pin (123); and a spring (184) comprising an end in contact with the butt (14) and another end in contact with the hook (182) to keep the barb (1822) engaged with the pin (123).

8. The crossbow according to claim 4, further comprises a pin (123) supported on the elongated portion (12) near the butt (14) and adapted for engagement with the hook unit (18) to keep the elongated portion (12) close to the butt (14).

9. The crossbow according to claim 8, wherein the hook unit (18) comprises:

a hook (182) comprising a barb (1822) for engagement with the pin (123); and a spring (184) comprising an end in contact with the butt (14) and another end in contact with the hook (182) to keep the barb (1822) engaged with the pin (123).

10. The crossbow according to claim 3, further comprises a pin (123) supported on the elongated portion (12) near the butt (14) and adapted for engagement with the hook unit (18) to keep the elongated portion (12) close to the butt (14).

11. The crossbow according to claim 10, wherein the hook unit (18) comprises:

a hook (182) comprising a barb (1822) for engagement with the pin (123); and a spring (184) comprising an end in contact with the butt (14) and another end in contact with the hook (182) to keep the barb (1822) engaged with the pin (123).

12. The crossbow according to claim 2, further comprises a pin (123) supported on the elongated portion (12) near the butt (14) and adapted for engagement with the hook unit (18) to keep the elongated portion (12) close to the butt (14).

13. The crossbow according to claim 12, wherein the hook unit (18) comprises:

a hook (182) comprising a barb (1822) for engagement with the pin (123); and a spring (184) comprising an end in contact with the butt (14) and another end in contact with the hook (182) to keep the barb (1822) engaged with the pin (123).

14. The crossbow according to claim 1, further comprises a pin (123) supported on the elongated portion (12) near the butt (14) and adapted for engagement with the hook unit (18) to keep the elongated portion (12) close to the butt (14).

15. The crossbow according to claim 14, wherein the hook unit (18) comprises:

a hook (182) comprising a barb (1822) for engagement with the pin (123); and a spring (184) comprising an end in contact with the butt (14) and another end in contact with the hook (182) to keep the barb (1822) engaged with the pin (123).

* * * * *